US005603339A

United States Patent [19]

Brazeal et al.

[11] Patent Number: 5,603,339

[45] Date of Patent: Feb. 18, 1997

[54] ROTATING COMB DEVICE

[76] Inventors: Sharon Brazeal, 79 Camp St., Middletown, Conn. 06457; Paul Berman, 1133 N. Clark St. #203, Los Angeles, Calif. 90069; Darrell Greenland, 934 Fourth St. #21, Santa Monica, Calif. 90403

[21] Appl. No.: 405,075

[22] Filed: Mar. 16, 1995

[51] Int. Cl.[6] ..... A45D 24/00

[52] U.S. Cl. ..... 132/119.1; 132/161; 132/271; 132/238

[58] Field of Search ..... 132/119.1, 151, 132/161, 237, 238, 271

[56] References Cited

U.S. PATENT DOCUMENTS

| | | | |
|---|---|---|---|
| 1,852,362 | 4/1932 | Newby | 132/161 |
| 2,304,315 | 12/1942 | Natkiel et al. | 132/150 |
| 2,348,339 | 5/1944 | Golden | 132/161 |
| 3,057,367 | 10/1962 | Langley | 132/161 |
| 3,180,342 | 4/1965 | Dietsche | 132/161 |
| 3,421,522 | 1/1969 | Magguilli | 132/119.1 |
| 3,474,795 | 10/1969 | Hantman et al. | 132/119.1 |

*Primary Examiner*—Gene Mancene
*Assistant Examiner*—Pedro Philogene

[57] ABSTRACT

A device for engaging and twisting a lock of hair. The inventive device includes a comb for engaging the hair. A rotating assembly is releasably coupled to the comb for rotating the comb during engagement with the hair to twist the hair into an elongated bundle configuration.

1 Claim, 3 Drawing Sheets

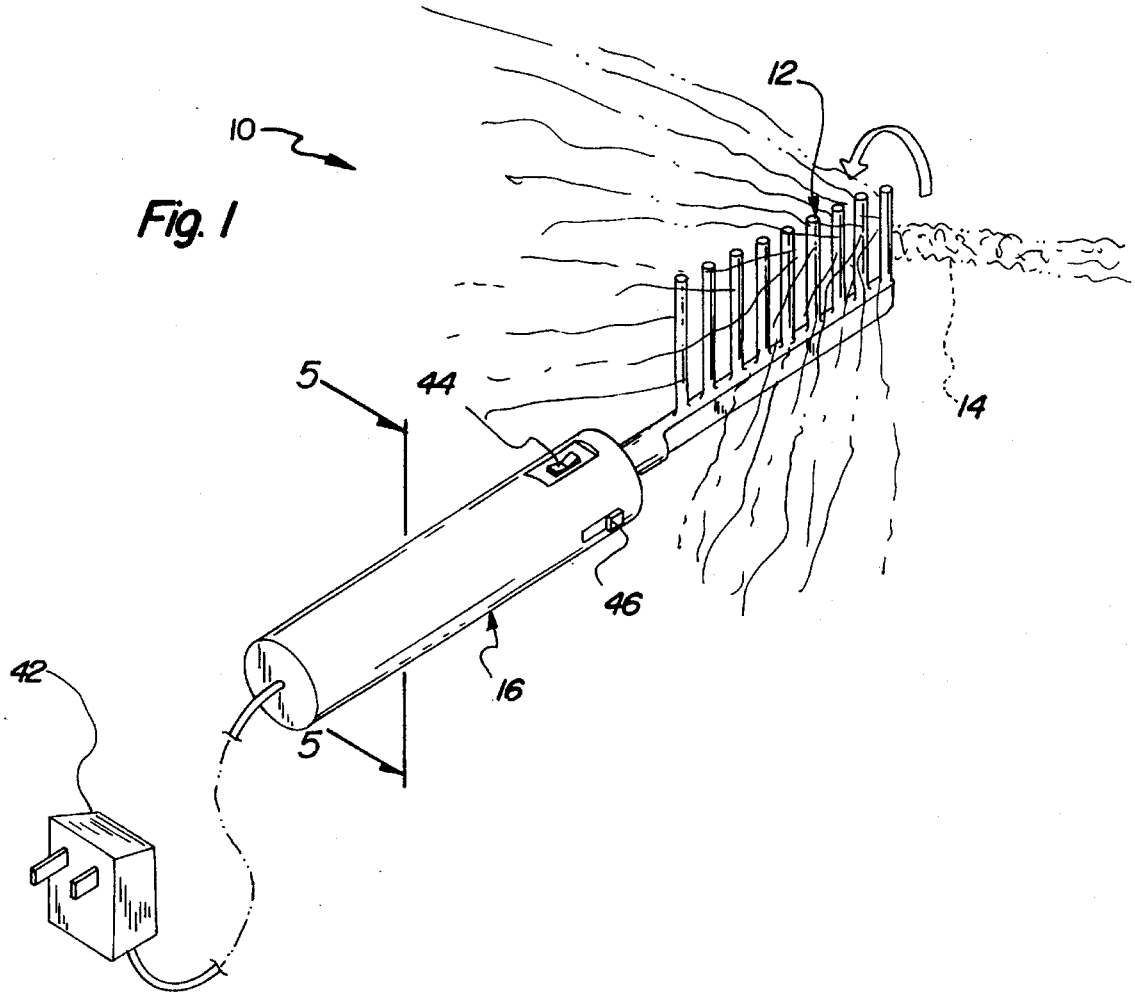
Fig. 1
Fig. 2
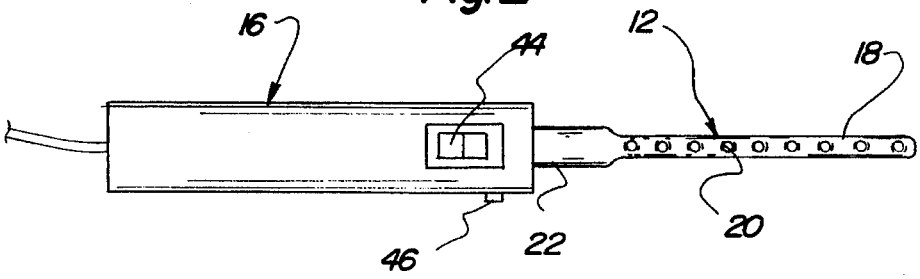

ROTATING COMB DEVICE

BACKGROUND OF THE INVENTION

1. Field of the Invention

The present invention relates to hair manipulating instruments and more particularly pertains to an rotating comb device for engaging and twisting a lock of hair.

2. Description of the Prior Art

The use of hair manipulating instruments is known in the prior art. More specifically, hair manipulating instruments heretofore devised and utilized are known to consist basically of familiar, expected and obvious structural configurations, notwithstanding the myriad of designs encompassed by the crowded prior art which have been developed for the fulfillment of countless objectives and requirements.

Known prior art hair manipulating instruments include U.S. Pat. No. 4,456,020; U.S. Pat. No. 4,222,398; U.S. Pat. No. 3,431,571; U.S. Pat. No. 3,427,674; U.S. Pat. No. 3,612,070; U.S. Pat. No. 3,605,762; U.S. Pat. No. 3,790,980; U.S. Pat. No. 3,894,547; and U.S. Pat. No. 4,884,583.

While these devices fulfill their respective, particular objectives and requirements, the aforementioned patents do not disclose a rotating comb device for engaging and twisting a lock of hair which includes a comb for engaging the hair, and a rotating assembly releasably coupled to the comb for rotating the comb during engagement with hair to twist the hair into an elongated bundle configuration.

In these respects, the rotating comb device according to the present invention substantially departs from the conventional concepts and designs of the prior art, and in so doing provides an apparatus primarily developed for the purpose of engaging and twisting a lock of hair.

SUMMARY OF THE INVENTION

In view of the foregoing disadvantages inherent in the known types of hair manipulating instruments now present in the prior art, the present invention provides a new rotating comb device construction wherein the same can be utilized for engaging and twisting a lock of hair. As such, the general purpose of the present invention, which will be described subsequently in greater detail, is to provide a new rotating comb device apparatus and method which has many of the advantages of the hair manipulating instruments mentioned heretofore and many novel features that result in a rotating comb device which is not anticipated, rendered obvious, suggested, or even implied by any of the prior art hair manipulating instruments, either alone or in any combination thereof.

To attain this, the present invention generally comprises a device for engaging and twisting a lock of hair. The inventive device includes a comb for engaging the hair. A rotating assembly is releasably coupled to the comb for rotating the comb during engagement with the hair to twist the hair into an elongated bundle configuration.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new rotating comb device apparatus and method which has many of the advantages of the hair manipulating instruments mentioned heretofore and many novel features that result in a rotating comb device which is not anticipated, rendered obvious, suggested, or even implied by any of the prior art hair manipulating instruments, either alone or in any combination thereof.

It is another object of the present invention to provide a new rotating comb device which may be easily and efficiently manufactured and marketed.

It is a further object of the present invention to provide a new rotating comb device which is of a durable and reliable construction.

An even further object of the present invention is to provide a new rotating comb device which is susceptible of a low cost of manufacture with regard to both materials and labor, and which accordingly is then susceptible of low prices of sale to the consuming public, thereby making such rotating comb devices economically available to the buying public.

Still yet another object of the present invention is to provide a new rotating comb device which provides in the apparatuses and methods of the prior art some of the advantages thereof, while simultaneously overcoming some of the disadvantages normally associated therewith.

Still another object of the present invention is to provide a new rotating comb device for engaging and twisting a lock of hair.

Yet another object of the present invention is to provide a new rotating comb device which includes a comb for engaging the hair, and a rotating assembly releasably coupled to the comb for rotating the comb during engagement with hair to twist the hair into an elongated bundle configuration.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a rotating comb device according to the present invention in use.

FIG. 2 is a top plan view of the invention.

DESCRIPTION OF THE PREFERRED EMBODIMENT

Figure 3:
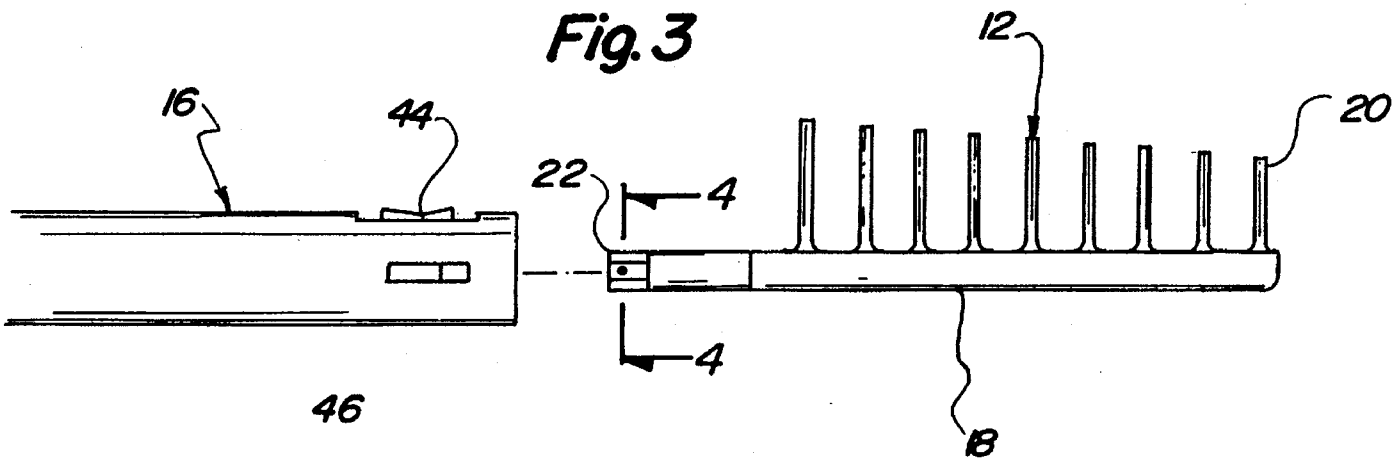
FIG. 3 is an exploded side elevation view of the invention.

With reference now to the drawings, and in particular to FIGS. 1–6 thereof, a new rotating comb device embodying the principles and concepts of the present invention and generally designated by the reference numeral 10 will be described.

More specifically, it will be noted that the rotating comb device 10 comprises a comb means 12 for engaging a lock of hair 14 to be twisted. A rotating means 16 is coupled to the comb means 12 for rotating the comb means about an axis to effect twisting of the lock of hair 14 into an elongated bundle configuration. The device 10 can be utilized to create a "dred-lock" hairstyle through such rotation and bundling of a plurality of locks of hair 14.

Figure 4:
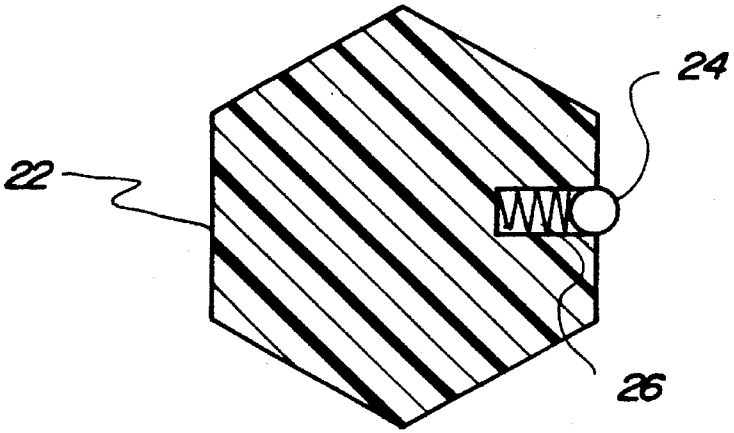
FIG. 4 is a cross sectional view taken along line 4—4 of FIG. 3.

As best illustrated in FIGS. 2 through 4, it can be shown that the comb means 12 according to the present invention 10 preferably comprises an elongated comb shaft 18 having a plurality of tines 20 projecting substantially orthogonally therefrom. The comb shaft 18 is shaped at a first end thereof so as to define a bit 22 engagable to the rotatable means 16 in a manner which will subsequently be described in more detail. As shown in FIG. 4, the bit 22 is polygonal in shape and preferably is of a hexagonal cross section. A detent ball 24 is positioned within an unlabelled cylindrical bore formed in the bit 22 and is coupled to the bit by a spring 26 engaged to an interior surface of the cylindrical bore and to a portion of the detent ball 24. The spring 26 operates to bias the detent ball 24 slightly exterior of the cylindrical bore of the bit 22. The detent ball 24 is operable to engage a portion of the rotating means 16 to secure the comb means relative thereto in manner which will also be subsequently described in more detail.

As shown in FIG. 3, the comb shaft 18 extends from the bit 22 to terminate in a free distal end or a second end. The tines 20 preferably taper from a first length proximal to the first end of the comb shaft 18 to a second length proximal to the second end of the comb shaft. Preferably, the first length is substantially greater than the second length, with the intermediate tines becoming progressively shorter towards the second end of the comb shaft. Thus, as the lock of hair 14 is wound into a tight elongated bundle configuration, the shorter length of the tine closest to the second end permits for ease of removal thereof from the tightened hair.

Figure 6:
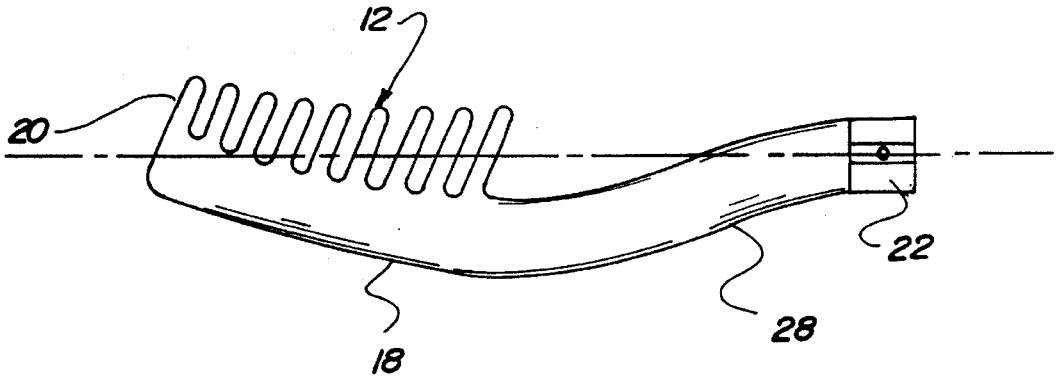
FIG. 6 is a side elevation view of an alternative comb means according to the present invention.

As shown in FIG. 3, the comb shaft 18 may be substantially straight in configuration wherein the tines 20 rotate within planes oriented perpendicularly to the longitudinal axis of the comb shaft. However, the comb shaft 18 of the comb means 12, as shown in FIG. 6, may be advantageously curved as at 28 such that the tines 20 reside within parallel planes oriented at oblique angles relative to a longitudinal axis directed through the bit 22. The tines 20 of the alternative comb means 12 similarly taper from a first length proximal to the first end of the comb shaft 18 to a second length proximal to the second end of the comb shaft, with the first length being substantially greater than the second length and the intermediate tines becoming progressively shorter towards the second end of the comb shaft. Because the comb shaft 18 of the alternative comb means is angled as at 28, the shorter tines 20 proximal to the second end of the comb shaft 18 will begin to project from the comb shaft in a first direction above relative to the longitudinal axis directed through the bit 22. In contrast, the longer tines 20 proximal to the first end of the comb shaft 18 will begin to project from the comb shaft in a second direction below relative to the longitudinal axis directed through the bit 22. By this structure, the alternative comb means 12 illustrated in FIG. 6 will rotate such that a lock of hair extending collinear to the longitudinal axis directed through the bit 22 will be disparately engaged by each of the tines 20 to facilitate ease of disengagement of the hair from the tines.

Figure 5:
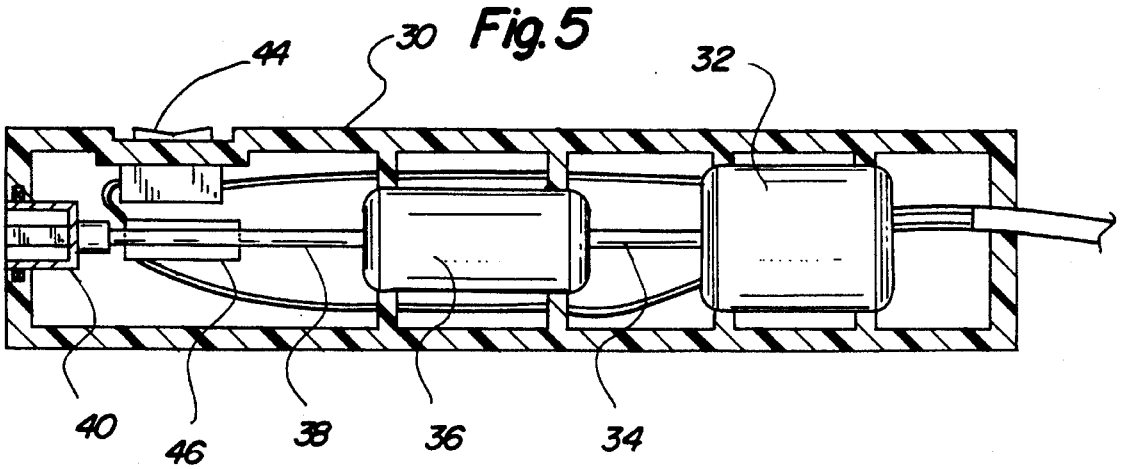
FIG. 5 is a cross sectional view taken along line 5—5 of FIG. 1.

As shown in FIGS. 1, 2 and 5, the rotating means according to the present invention 10 preferably comprises a cylindrical main body 30 of an elongated configuration within which a reversible motor 32 is mounted. The motor 32 includes a projecting motor shaft 34 mechanically coupled to a gear reducer 36 having an output shaft 38. The output shaft 38 extends into mechanical communication with a chuck 40 rotatably mounted through an aperture in the cylindrical main body 30 upon a plurality of unlabelled bearings. The motor 32 can be powered by a transformer 42, as shown in FIG. 1 or alternatively, by rechargeable batteries contained within the cylindrical main body 30. Regardless of the power source, the reversible motor 32 is controlled by a reversible switch 44 which directs the motor 32 to run in either of two directions. A speed control 46 comprising a rheostat, potentiometer, or other speed control means is positioned in electrical communication with the reversible motor 32 for controlling a rotational speed of the motor shaft 34.

As shown in FIG. 5, the chuck 40 is shaped so as to define a polygonal bore within which the bit 22 can be positioned. Preferably the polygonal bore of the chuck 40 is substantially hexagonal in shape so as to cooperatively receive the bit 22 as illustrated in FIG. 4. The chuck 40 includes an unillustrated detent recess within which the detent ball 24 projects when the bit 22 is engaged to the chuck 40 to secure the comb means 12 relative to the rotating means 16. By this structure, a plurality of disparate comb means 12 can be interchangeable coupled to the rotating means 16 as desired.

In use, the rotating comb device 10 according to the present invention can be utilized to engage and rotate a lock of hair 14 into an elongated bundle configuration to form a "dred-lock" hairstyle. Both the speed and the direction of rotation of the comb means 12 can be controlled through a use of the speed control 46 and the reversing switch 44 as desired.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A rotating comb device comprising:

a comb means for engaging a plurality of hair strands, the comb means having an elongated shaft with a plurality of tines projecting therefrom, the comb shaft having a first end being shaped so as to define a bit, the comb shaft terminating at a second end, the tines tapering from a first length proximal to the first end of the comb shaft to a second length proximal to the second end of the comb shaft, wherein the first length is substantially greater than the second length, with the intermediate tines therebetween becoming progressively shorter towards the second end of the comb shaft; and a rotating means coupled to the bit of the comb means for rotating the comb means about an axis to effect twisting of the lock of hair into an elongated bundle configuration, the rotating means having a cylindrical main body, a reversible motor mounted within the body, a gear reducer mechanically coupled to a motor shaft of the motor, and a chuck rotatably mounted through an aperture in the cylindrical main body and mechanically coupled with an output shaft of the gear reducer, the chuck being in receipt of the bit the motor further having a reversible switch and a speed control means with each being in electrical communication therewith, whereby when the rotating means being coupled to the comb means for rotation of the comb means about an axis for effecting twisting of the plurality of hair strands into a dred-lock and continually gathering hair strands for creating a plurality of dred locks.

* * * * *